US006896066B2

(12) United States Patent
Gil

(10) Patent No.: US 6,896,066 B2
(45) Date of Patent: May 24, 2005

(54) SPRINKLER APPARATUS AND METHOD FOR CONTROLLING THE SAME

(75) Inventor: Jong Jin Gil, 1-101 Kumgang Apt., 16-19, Sosa-dong, Wonmi-ku, Boochun-city, Kyoungki-do 420-050 (KR)

(73) Assignee: Jong Jin Gil, Kyoungki-do (KR)

( * ) Notice: Subject to any disclaimer, the term of this patent is extended or adjusted under 35 U.S.C. 154(b) by 385 days.

(21) Appl. No.: 10/001,657

(22) Filed: Oct. 22, 2001

(65) Prior Publication Data

US 2002/0036090 A1 Mar. 28, 2002

Related U.S. Application Data

(63) Continuation of application No. PCT/KR00/00186, filed on Mar. 8, 2000.

(30) Foreign Application Priority Data

Feb. 21, 2000 (KR) ..... 10-2000-0008114

(51) Int. Cl.[7] ..... A66C 2/00
(52) U.S. Cl. ..... 169/46; 169/61
(58) Field of Search ..... 169/16, 37, 43, 169/46, 54, 56, 57, 60, 61; 239/75; 340/577, 584, 590, 592

(56) References Cited

U.S. PATENT DOCUMENTS

| | | | | |
|---|---|---|---|---|
| 2,245,144 A | | 6/1941 | Griffith | 169/37 |
| 3,884,304 A | * | 5/1975 | Messerschmidt et al. | 169/16 |
| 3,893,513 A | * | 7/1975 | Marsh | 169/16 |
| 4,199,029 A | * | 4/1980 | Marek | 169/61 |
| 5,622,225 A | * | 4/1997 | Sundholm | 169/61 |

FOREIGN PATENT DOCUMENTS

WO WO 92/21998 11/1993

* cited by examiner

*Primary Examiner*—Gene Mancene
*Assistant Examiner*—Thach H. Bui
(74) *Attorney, Agent, or Firm*—Knobbe Martens Olson & Bear LLP.

(57) ABSTRACT

A sprinkler apparatus is provided. The apparatus comprises a sprinkler head and a sprinkler head controller. The sprinkler head has a heater and a thermal fuse, the heater is configured to generate first and second heat based on first and second currents. The thermal fuse melts by the second heat, and the sprinkler head is configured to discharge an extinguishing liquid therethrough in response to the melting of the thermal fuse. The sprinkler head controller is connected to the sprinkler head, and is configured to provide the first current to the heater and detect the amount of current flowing through the heater, and diagnose the status of the sprinkler head based on the detected current.

45 Claims, 13 Drawing Sheets t1 = synchronous information t2 = first information interval t3 = second information interval p1 < p2

SPRINKLER APPARATUS AND METHOD FOR CONTROLLING THE SAME

RELATED APPLICATION

This application is a continuation application of PCT application No. PCT/KR00/00186 filed on Mar. 8, 2000, and published under PCT Article 21(2) on Nov. 8, 2001 in English, which is hereby incorporated by reference herein.

TECHNICAL FIELD

The present invention relates in general to a sprinkler apparatus and a method for controlling the same, and more particularly to a fire fighting sprinkler apparatus and a method for controlling the same, in which sprinklers installed in various places check the presence of faults therein by themselves, are automatically actuated locally when fires occur in their places and controlled in a centralized manner by a central control station, so that they can more effectively cope with the occurrence of fires.

BACKGROUND ART

Generally, sprinklers are fire fighting equipment installed on the ceilings of buildings for spraying extinguishing liquid, or water, upon sensing the occurrence of a fire, so as to extinguish the fire.

A typical sprinkler head H comprises, as shown in FIG. 9, an extinguishing liquid discharging nozzle 1 coupled with an extinguishing liquid supply pipe 33 via a pipe of the discharging nozzle 1, an extinguishing liquid diffusing plate 6 fitted horizontally under and to the lower end of the O-ring-shaped body 2, a valve plate 3 for normally holding the discharging nozzle 1 closed, a trigger 4 installed within a space between the valve plate 3 and the bottom of the body 2 for supporting the valve plate 3, and a thermal fuse 7 installed within the trigger 4. The thermal fuse F includes, as shown in FIG. 10, a hollow drum-shaped casing 11 enclosed at its bottom, low-temperature fusing lead 13 filled within the casing 11 and held solid at room temperature, and an actuating pin 12 held within the lead 13 at its lower end and projected out of the top of the casing 11 at its upper end. As the ambient temperature rises due to the occurrence of a fire, the low-temperature fusing lead 13 in the thermal fuse 7 fuses to become a liquid state, thereby causing the actuating pin 12 to be sunk in the lead 13 and thus the valve plate supporting balance of the trigger 4 to be broken. As a result, the valve plate 3 opens the extinguishing liquid discharging nozzle 1 to spray extinguishing liquid.

There has been proposed another conventional sprinkler wherein a glass ampule (not shown) filled with a temperature-expansive gas is provided instead of the above low-temperature fusing lead-type thermal fuse. If a fire occurs, then the gas in the glass ampule expands to break the glass ampule, thereby causing a valve plate supporting force to be lost. This sprinkler is substantially the same in operation as that with the low-temperature lead thermal fuse.

On the other hand, the above-mentioned conventional sprinklers using either the low-temperature lead fuse or temperature-expansive glass ampule have such a structure that the fuse or glass ampule reacts directly to substantial heat of a fire. In this regard, such conventional sprinklers are disadvantageous in that they have a very slow response to the initial stage of a fire because they are not actuated in the event of the fire until the ambient temperature reaches a fusing point of the low-temperature lead or an expansion-breaking point of the glass ampule. In connection with such a problem, U.S. Pat. No. 2,245,144, invented by William B. Griffith, et al., shows a technique for breaking or melting the glass ampule or low-temperature lead fuse using not the fire heat but electric heating means. In this patent, as shown in FIG. 11, in the event of a fire, a diaphragm (41 in the patent) first expands at a low temperature prior to the melting of the fuse and then applies electric power to an electric heating coil (20 in the patent) around the fuse or glass ampule. In this technique, the diaphragm functions as a mechanical temperature sensor expanding when the ambient temperature exceeds a predetermined threshold value and also as an electrical switch for applying electric power to electric heating means (electric heating coil) upon the expansion.

Another approach to using the electric heating means around the fuse or glass ampule is shown in International Application No. PCT/FI93/00164 (International Publication No. WO 93/21998), inverted by Sundholm, Göran. In this publication, as shown in FIGS. 12*a*, 12*b* and 12*c*, an electric heating coil (8 in the publication) of memory metal is laid around the glass ampule. The memory metal coil is held contracted at room temperature to hold an electric circuit opened (see FIG. 12*a*). When the ambient temperature reaches a predetermined threshold value due to the occurrence of a fire, the memory metal coil changes (or expands) its shape to function as a switch for closing the electric circuit. After closing the electric circuit, the memory metal coil functions as the electric heating means for heating the fuse or ampule. For reference, FIG. 12*b* shows a state where the memory metal coil expands and makes an electrical connection to act as a heater, and FIG. 12*c* shows a state where a spindle (5 in the publication) is pressed downwardly (to spray extinguishing liquid) under the influence of a spring (6 in the publication) after the glass ampule is broken.

The sprinklers shown in the '144 patent and '21998 publication comprise the electric heating means for heating the fuse or glass ampule at a predetermined low temperature before the substantial fire heat reaches the fuse or glass ampule. In this regard, such sprinklers are advantageous in that they have a faster response to the initial stage of a fire than that of the conventional sprinklers using the glass ampule or fuse breaking or melting due to the direct heating by the substantial fire heat. However, such sprinklers still have the following disadvantages.

Firstly, because fire fighting equipment such as sprinklers is at present installed in almost all buildings but provided only against an emergency such as the occurrence of a fire, it is mostly left unused for a lengthy period of time due to the event of no fire. As a result, the fire fighting equipment may be aged or damaged partially in its electric circuit due to insincere maintenance, finally becoming a useless thing in the actual event of a fire. In order to solve this problem, there is a need to frequently test the operations of the sprinklers. However, it is not easy to frequently test a large number of sprinklers installed on the ceiling.

Secondly, in almost all cases, a fire occurs beginning with a certain local place, and only a sprinkler installed in that local place is actuated and sprinklers installed in other rooms adjacent thereto are not actuated, thereby making it impossible to prevent the fire from being spread toward the adjacent rooms. On the other hand, in the previously stated '144 patent, another switching means (37 in the patent) is provided in addition to the diaphragm-type mechanical/electrical switching means to manually close the electric circuit. The provision of such switching means may establish manual electrical connections to sprinklers in other places than a place where a fire occurs, as needed. However, this '144 patent does not show any means (for example, means for connection between sprinklers, means for acquiring information needed for an operator's operation, command transfer means, etc.) embodied for controlling individual electrical connections to the respective sprinklers.

DISCLOSURE OF THE INVENTION

Therefore, the present invention has been made in view of the above problems, and it is an object of the present invention to provide a fire fighting sprinkler apparatus and a method for controlling the same, in which sprinklers with low-temperature lead fuses (or glass ampules) electrically heatable in an indirect manner are installed in various places, check the presence of faults therein by themselves at regular intervals, are automatically actuated locally when fires occur in their places and controlled in a centralized manner by a central control station, and an operator in the central control station remotely checks the presence of faults in the sprinklers at any time if necessary and controls the operations of the sprinklers in the centralized manner in connection with one another in such a manner that he can determine and actuate desired ones of sprinklers in other places than a place where a fire occurs, thereby more effectively coping with the fire occurrence.

In accordance with one aspect of the present invention, the above and other objects can be accomplished by a provision of a sprinkler apparatus comprising a heater operable by temperature sensing means, a thermal fuse melting by heat from the heater, and a valve plate for opening an extinguishing liquid discharging nozzle of a sprinkler head in response to the melting of the thermal fuse to discharge extinguishing liquid, wherein the sprinkler apparatus further comprises a sprinkler head controller including a transmitter and a receiver, the sprinkler head controller performing a self-diagnostic operation according to an algorithm contained therein in such a manner that it supplies a small amount of current to the heater and detects the amount of current flowing through the heater and externally transmitting the self-diagnostic result and a temperature value sensed by the temperature sensing means; and a main computer installed in a central control station for informing an operator of the self-diagnostic result and temperature value transmitted from the sprinkler head controller.

In accordance with another aspect of the present invention, there is provided a method for controlling a sprinkler apparatus which includes at least one sprinkler head having a heater for generating heat and a thermal fuse melting by the heat from the heater to actuate the sprinkler head, at least one sprinkler head controller for controlling the operation of the sprinkler head, and a main computer installed in a central control station, comprising the first step of allowing the sprinkler head controller to actuate the sprinkler head in accordance with a temperature value sensed by temperature sensing means and transmit information about the sensed temperature value and the actuated state of the sprinkler head to the main computer; the second step of allowing the sprinkler head controller to perform a self-diagnostic operation for the sprinkler head according to an algorithm contained therein or in response to a control command from the main computer and transmit the self-diagnostic result to the main computer; and the third step of allowing the main computer in the central control station to inform an operator of the sensed temperature value, the actuated state of the sprinkler head and the self-diagnostic result transmitted from the sprinkler head controller.

BRIEF DESCRIPTION OF THE DRAWINGS

The above and other objects, features and other advantages of the present invention will be more clearly understood from the following detailed description taken in conjunction with the accompanying drawings, in which:

FIG. 12 shows a structure of another conventional sprinkler, wherein:

BEST MODE FOR CARRYING OUT THE INVENTION

Figure 1:
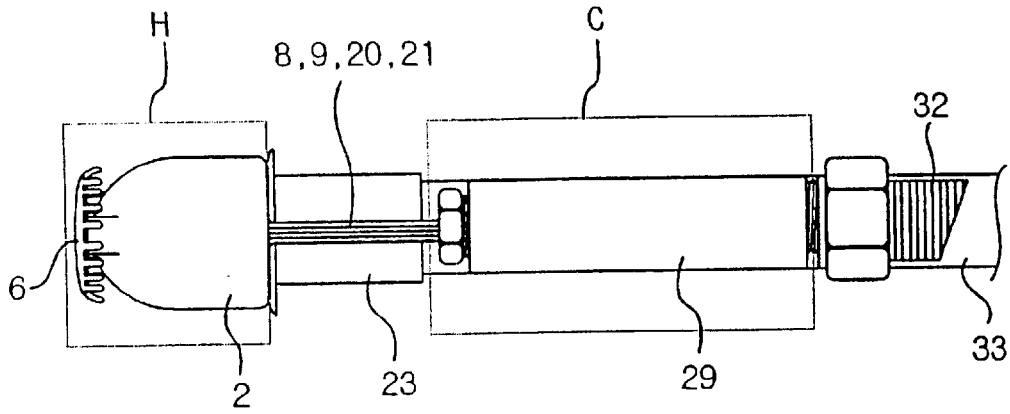
FIG. 1 is a schematic view showing a structure of a sprinkler in accordance with the preferred embodiment of the present invention.
Figure 2:
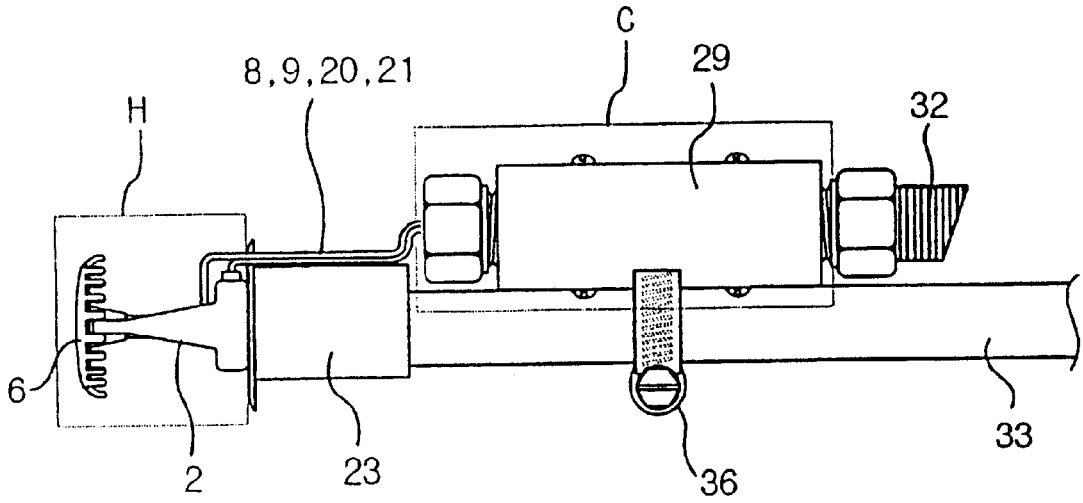
FIG. 2 is a side view of the sprinkler in FIG. 1.

FIG. 1 is a schematic view showing a structure of a sprinkler in accordance with the preferred embodiment of the present invention and FIG. 2 is a side view of the sprinkler in FIG. 1. As shown in these drawings, the sprinkler comprises a head H for sensing the ambient temperature and discharging extinguishing liquid in accordance with the sensed result, and a sprinkler head controller C for controlling the operation of the sprinkler and checking the presence of a fault in the sprinkler.

In FIGS. 1 and 2, the reference numeral 2 denotes the body of the sprinkler head H, 29 denotes the body of the sprinkler head controller C, 8 and 9 denote conductors for electrically connecting the sprinkler head H to the sprinkler head controller C, 20 and 21 denote conductors for electrically connecting a thermistor 22 (see FIG. 5) to the sprinkler head controller C, and 32 denotes a wire duct containing power lines for applying electric power to the sprinkler head H and controller C and signal lines for transmitting and receiving signals to/from other equipment. Also, the reference numeral 33 denotes an extinguishing liquid supply pipe coupled with an extinguishing liquid storage tank (not shown), 23 denotes a pipe coupling socket for coupling the sprinkler head H with the extinguishing liquid supply pipe 33, and 36 denotes a fixing band for fixing the body 29 of the sprinkler head controller C to the extinguishing liquid supply pipe 33.

Figure 3:
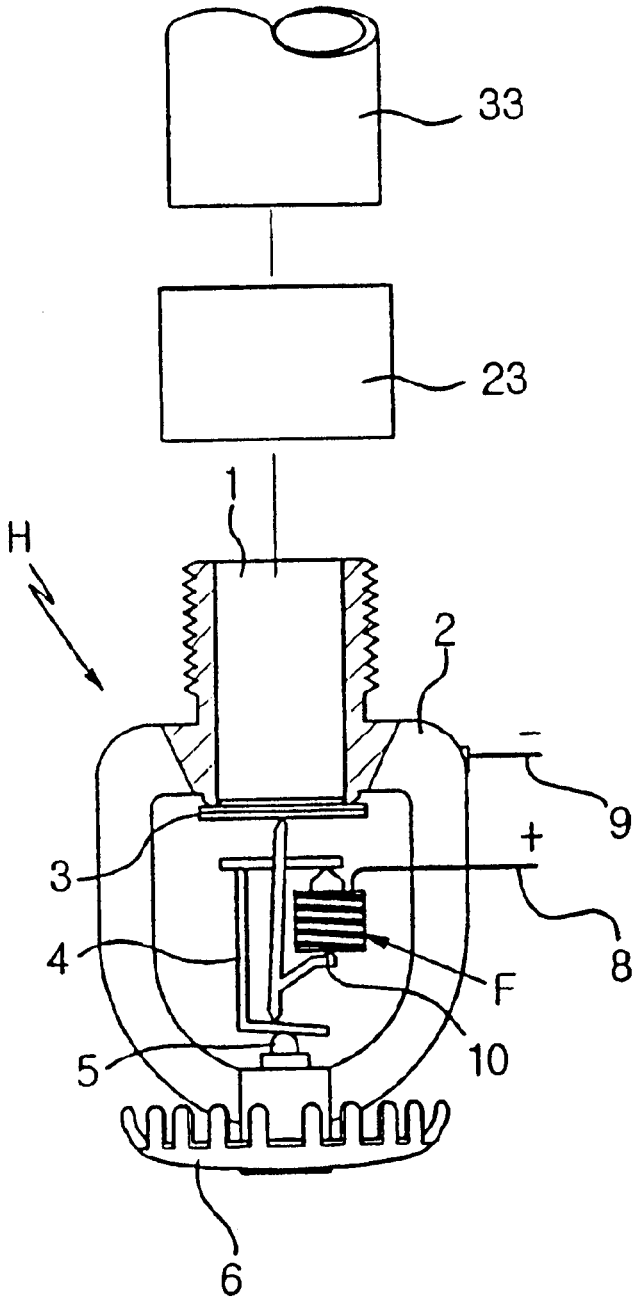
FIG. 3 is a schematic view showing a structure of a sprinkler head in FIG. 1.

The sprinkler head H includes, as shown in FIG. 3, an extinguishing liquid discharging nozzle 1 coupled at the upper end of the body 2 with the extinguishing liquid supply pipe 33 via the pipe coupling socket 23, and an extinguishing liquid diffusing plate 6 fitted horizontally under and to the lower end of the body 2, and a negative electrode 9 attached on the outer surface of the body 2.

A valve plate 3 is supported by a linked trigger 4 toward the lower end of the extinguishing liquid discharging nozzle 1 to normally hold the discharging nozzle 1 closed. The trigger 4 is made of any proper conductive material and is electrically grounded to keep uneven balance via a thermal fuse F between a binding bolt 5, which fits the diffusing plate 6 to the body 2, and the valve plate 3.

Figure 4A:
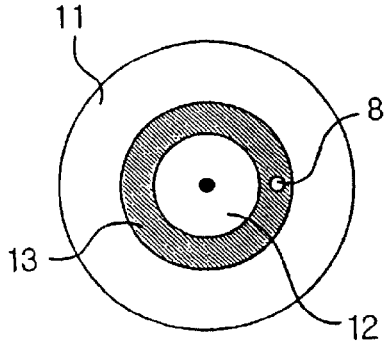
FIG. 4*a* is a plan view of a thermal fuse in FIG. 3.
Figure 4B:
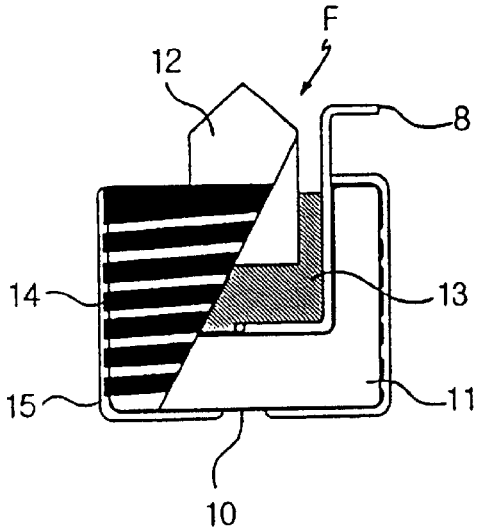
FIG. 4*b* is a partially broken, side view of the thermal fuse in FIG. 3.
Figure 4C:
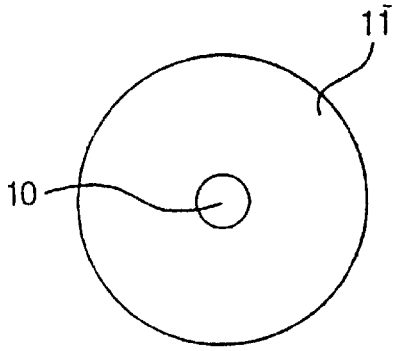
FIG. 4*c* is a bottom view of the thermal fuse in FIG. 3.

The thermal fuse F includes, as shown in FIGS. 4*a* to 4*c*, a hollow drum-shaped, non-conductive casing 11 made of any proper non-conductive material (for example, ceramic) and enclosed at its bottom, low-temperature fusing, conductive element 13 made of any proper conductive material (for example, lead), filled within the casing 11, held solid at room temperature and easily fusing at a low temperature, and a conical, non-conductive actuating pin 12 made of any proper non-conductive material (for example, ceramic), held within the conductive element 13 at its lower end and projected out of the top of the casing 11 at its upper end A negative electrode contact member 10 is attached on the lower end of the non-conductive casing 11 at its one end and connected to the negative electrode 9 at its other end, and a positive electrode 8 is attached on the inner surface of the casing 11. Helically laid on the outer surface of the non-conductive casing 11 is an electric heater (for example, a carbon paste or metal film) 14 connected to the negative electrode contact member 10 at its one terminal and to the positive electrode 8 via the conductive element 13 at its other terminal. An anticorrosive, insulating film 15 is coated on the outer surface of the electric heater 14, or the outermost portion from the outer surface of the non-conductive casing 11, to protect the electric heater 14.

Figure 5:
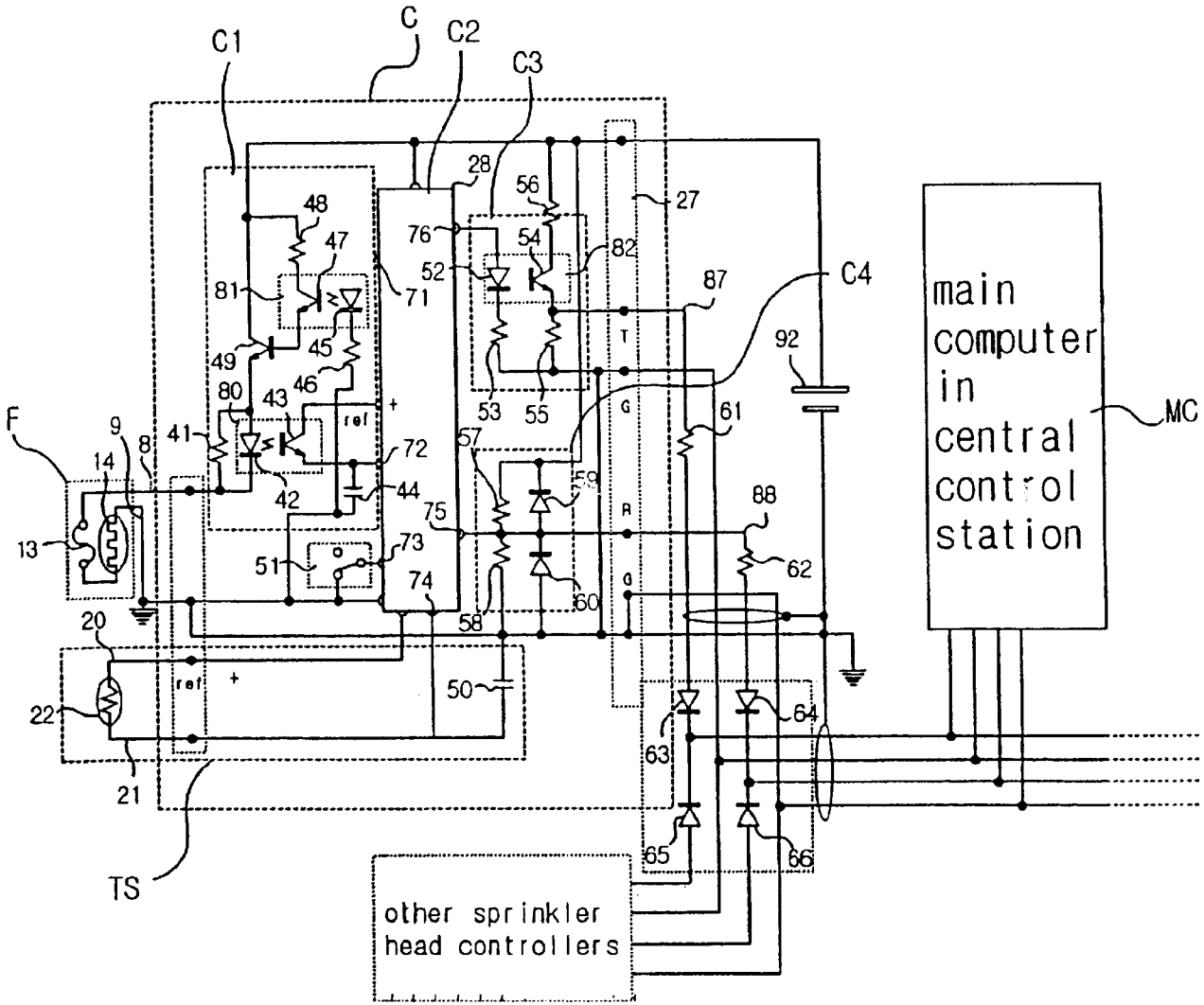
FIG. 5 is a circuit diagram of a sprinkler apparatus in accordance with the preferred embodiment of the present invention.

FIG. 5 is a circuit diagram of a sprinkler apparatus in accordance with the preferred embodiment of the present invention. As shown in this drawing, the sprinkler apparatus comprises the thermal fuse F, a temperature sensing circuit TS, the sprinkler head controller C and a main computer MC in a central control station.

The temperature sensing circuit TS is installed in the sprinkler head H to readily sense high heat generated upon the occurrence of a fire in a building. To this end, the temperature sensing circuit TS includes the thermistor 22 having its resistance varying with the ambient temperature, and a temperature sensing capacitor 50.

The sprinkler head controller C includes a current supply/feedback circuit C1 for supplying a predetermined amount of rated current to the thermal fuse F and detecting the amount of current fed from the thermal fuse F back thereto, and a one-chip microcontroller C2 for controlling the current supply/feedback circuit C1 to supply the predetermined amount of rated current to the thermal fuse F. The microcontroller C2 is further adapted to analyze the amount of current detected by the current supply/feedback circuit C1 and determine the presence of a fault in the thermal fuse F and an aged state thereof in accordance with the analyzed result. The sprinkler head controller C further includes a signal transmitter C3 for transmitting an output signal from the microcontroller C2 to the main computer MC in the central control station, a signal receiver C4 for receiving an output signal from the main computer MC and transferring it to the microcontroller C2, and a switch 51 for storing an identification number.

The current supply/feedback circuit C1 is provided with a control photocoupler 81, a switching transistor 49, a current sensing photocoupler 80, a current sensing capacitor 44 and a plurality of device protection resistors 46 and 48.

The signal transmitter C3 is provided with a photocoupler 82, a plurality of device protection resistors 53, 55 and 56 and a signal transmission line 87, and the signal receiver C4 is provided with a pair of voltage-division resistors 57 and 58, a pair of diodes 59 and 60 for preventing a signal overload and limiting a reverse voltage, and a signal reception line 88.

A plurality of bypassing diodes 63 and 65 or 64 and 66 are connected to each of the signal transmission line 87 and signal reception line 88 to prevent signal interferences with the other sprinkler head controllers connected in parallel to the same line. As a result, even though a specific sprinkler head controller is damaged, cut, short-circuited or broken down due to a fire, the other sprinkler head controllers will be maintained in operation without any interference from the specific sprinkler head controller.

Noticeably, provided that sprinkler head controllers in a large number of sprinklers comprise signal lines to the main computer MC in the central control station, respectively, the wire layout in the building will become complicated and the signal lines will be wasteful in number. In special consideration of this point, according to the present invention, the sprinkler head controllers are connected in parallel to the main computer MC in the central control station via signal lines of a two-phase/four-wire system as shown in FIG. 5. As a result, the wire layout can be simplified and the signal lines can significantly be reduced in number regardless of the number of sprinklers installed in the building.

For reference, the reference numerals 61 and 62 in FIG. 5, not described, denote specific resistances of the signal transmission line 87 and signal reception line 88, respectively, and 92 denotes a direct current (DC) power source (for example, a battery) for supplying DC power to the sprinkler head controller C and temperature sensing circuit TS.

The main computer MC is installed in the central control station to remotely control a plurality of sprinkler head controllers C and remotely check states of respective sprinklers. Namely, the main computer MC receives information from the sprinkler head controllers C, such as self-diagnostic results, sensed temperature results and actuated states, and displays the received information on display means (for example, a monitor) contained therein. Further, the main controller MC gives an alarm to an operator in the case of danger. In this manner, the main computer MC informs the operator of states of respective sprinkler heads H and transmits a plurality of control commands to the sprinkler head controllers C according to key operations by the operator or an algorithm contained therein to instruct each of the sprinkler head controllers C to perform a self-diagnostic operation or to compulsorily actuate the associated sprinkler head H.

Now, a detailed description will be given of the operation of the sprinkler apparatus with the above-mentioned construction in accordance with the preferred embodiment of the present invention with reference to FIGS. 1 to 8.

First, a self-diagnostic operation for the thermal fuse F by the sprinkler head controller C will be mentioned.

In the self-diagnostic operation, the microcontroller C2 in the sprinkler head controller C applies a pulse width modulation (PWM) signal to a light emitting diode 45 in the control photocoupler 81 for a predetermined period of time. At this time, the PWM signal has a duty factor set to such a value that can supply such a small amount of current as to cause no physical variation in the low-temperature fusing element 13 in the thermal fuse F.

In response to the PWM signal from the microcontroller C2, a phototransistor 47 in the control photocoupler 81 and the switching transistor 49 are sequentially switched to supply a predetermined amount of rated test current to the thermal fuse F. At this time, a voltage corresponding to the amount of current flowing to the thermal fuse F is generated across a resistor 41 connected in parallel to a light emitting diode 42 in the current sensing photocoupler 80, and the light emitting diode 42 thus generates light of an intensity corresponding to the voltage generated across the resistor 41. As a result, current of an amount corresponding to the intensity of light generated from the light emitting diode 42 flows between a collector and emitter of a phototransistor 43 in the current sensing photocoupler 80. Then, the current flowing between the collector and emitter of the phototransistor 43 is charged on the current sensing capacitor 44. At this time, the microcontroller C2 detects charging/discharging times of the capacitor 44 through its bidirectional input/output port 72, determines the amount of current flowing through the thermal fuse F on the basis of the detected charging/discharging times and diagnoses an endurance of the thermal fuse F and the presence of a fault therein in accordance with the determined result. Then, the microcontroller C2 outputs a control signal based on the diagnosed result to the transmitting photocoupler 82 through its output port 76, thereby causing the photocoupler 82 to generate a pulse signal and transmit it to the main computer MC in the central control station. In other words, with the lapse of a lengthy period of time from the installation of the thermal fuse F, internal lines of the thermal fuse F or connection lines from the thermal fuse F to the power source 92 may be cut or short-circuited due to corrosion or other factors, resulting in a variation in resistance on a current path of the thermal fuse F consisting of positive electrode 8 low-temperature fusing element 13 heater 14 negative electrode contact member 10 trigger 4 negative electrode 9. In this case, the amount of current flowing through the thermal fuse F becomes different from the previous one, thereby causing the charging/discharging times of the capacitor 44 to become different from the previous ones. As a result, the microcontroller C2 can check the state of the thermal fuse F on the basis of the charging/discharging times of the capacitor 44.

Next, a description will be given of the operation of the sprinkler head controller C which senses the occurrence of a fire through the temperature sensing circuit TS and thus actuates the sprinkler head H.

The thermistor 22 in the temperature sensing circuit TS has its resistance varying with the ambient temperature, and charging/discharging times of the capacitor 50 vary with the resistance variation of the thermistor 22. Namely, a time constant based on a resistance R of the thermistor 22 and a capacitance C of the capacitor 50 vary. At this time, the microcontroller C2 in the sprinkler head controller C detects the charging/discharging times of the capacitor 50 through its bidirectional input/output port 74, senses the ambient temperature on the basis of the detected charging/discharging times and determines the occurrence of a fire in accordance with the sensed result. Then, the microcontroller C2 outputs a control signal based on the determined result to the transmitting photocoupler 82 through its output port 76, thereby causing the photocoupler 82 to generate a pulse signal and transmit it to the main computer MC in the central control station. In the case where the occurrence of a fire is determined, the microcontroller C2 applies a PWM signal to the light emitting diode 45 in the control photocoupler 81. At this time, the PWM signal has a duty factor set to such a value that can supply such a predetermined amount of rated current as to allow the heater 14 in the thermal fuse F to generate high heat sufficient to fuse the conductive element 13. In response to the PWM signal from the microcontroller C2, the phototransistor 47 in the control photocoupler 81 and the switching transistor 49 are sequentially switched to supply the predetermined amount of rated current to the thermal fuse F.

The current from the switching transistor 49 flows through the current path of the thermal fuse F consisting of positive electrode 8 low-temperature fusing element 13 heater 14 negative electrode contact member 10 trigger 4 negative electrode 9. At this time, the heater 14 generates electric heat higher than a fusing point of the low-temperature fusing element 13, and the drum-shaped non-conductive casing 11 and conductive element 13 are simultaneously heated due to the electric heat generated from the heater 14. As the low-temperature fusing element 13 fuses due to its heating, the overlying conical actuating pin 12 moves downwardly, thereby causing the uneven balance of the trigger 4 to be broken and thus the valve plate 3 to be opened. As a result, extinguishing liquid is supplied from the extinguishing liquid storage tank (not shown) to the discharging nozzle 1 through the supply pipe 33 and then discharged from the discharging nozzle 1. The extinguishing liquid discharged from the discharging nozzle 1 is reflected and diffused by the diffusing plate 6 and thus sprayed within the building. At the same time, the current path of the thermal fuse F consisting of positive electrode 8 low-temperature fusing element 13 heater 14 negative electrode contact member 10 trigger 4 negative electrode 9 is blocked, thereby allowing no current to flow to the heater 14.

Figure 6:
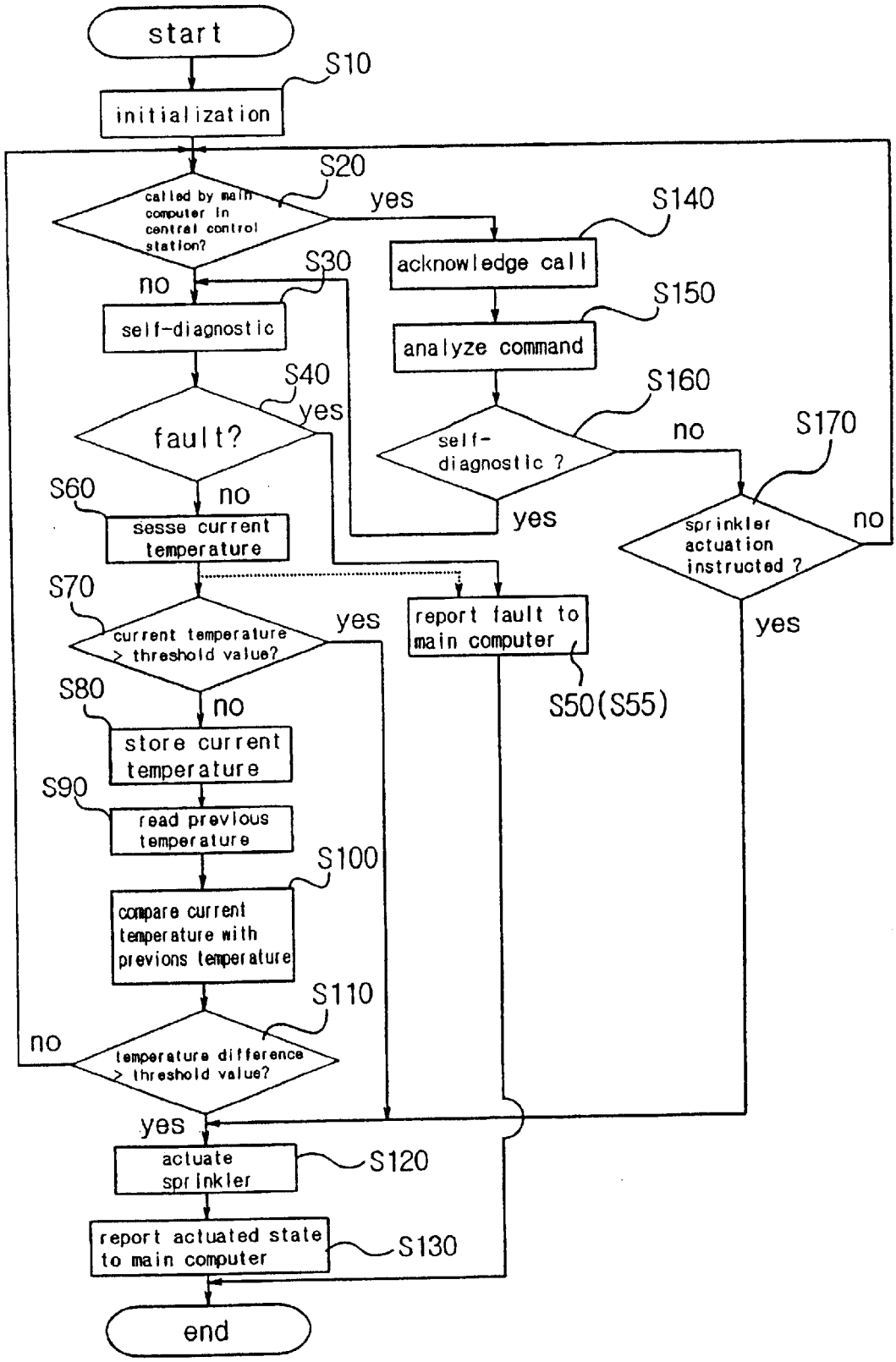
FIG. 6 is a flowchart illustrating a control operation of a sprinkler head controller in FIG. 5 and the transfer of signals between the sprinkler head controller and a main computer in a central control station in FIG. 5.

Next, a description will be given of a control operation of the sprinkler head controller C and the transfer of signals between the sprinkler head controller C and the main computer MC in the central control station with reference to a flowchart of FIG. 6. This description will be made centering around the sprinkler head controller C.

Figure 7:
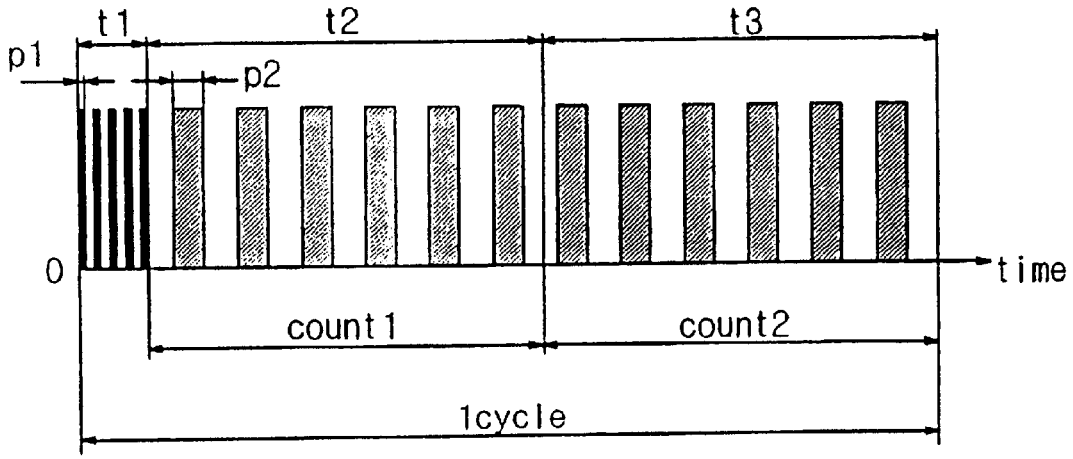
FIG. 7 is a waveform diagram of a synchronous signal used for the signal transfer between the sprinkler head controller and main computer in FIG. 5.
Figure 8:
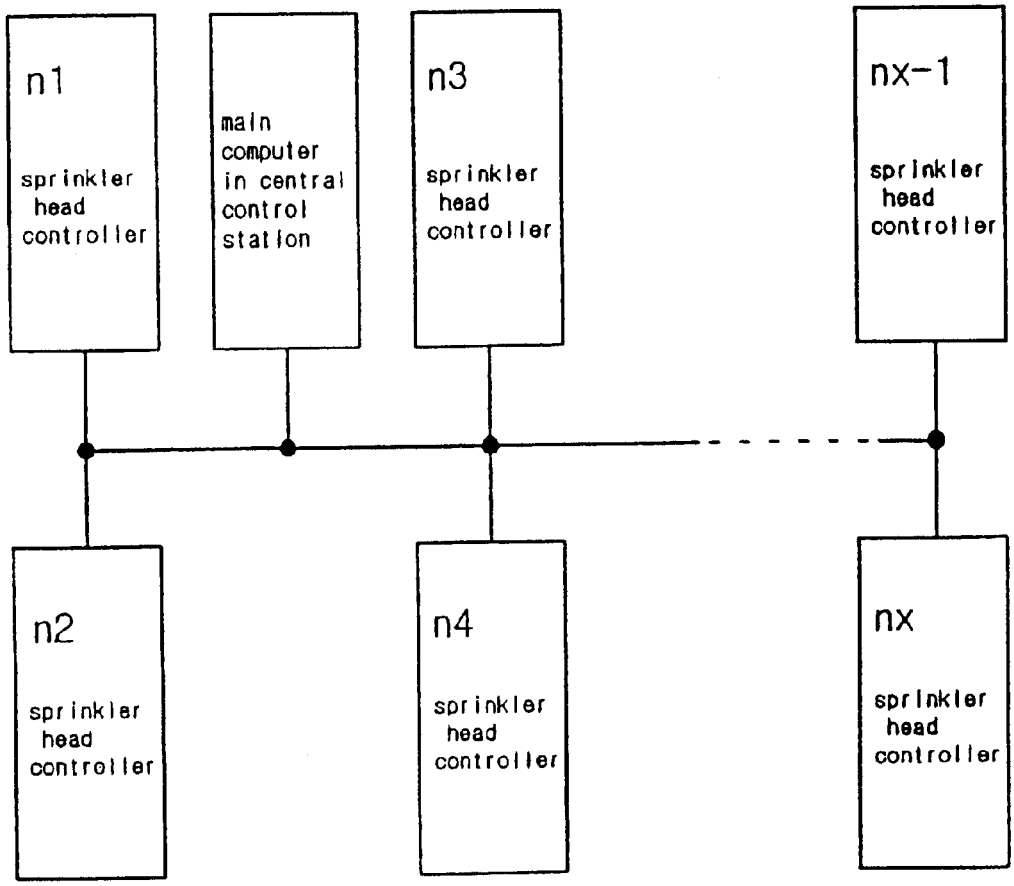
FIG. 8 is a block diagram showing connections between a plurality of sprinkler head controllers and a main computer in a central control station in accordance with the preferred embodiment of the present invention.
Figure 9:
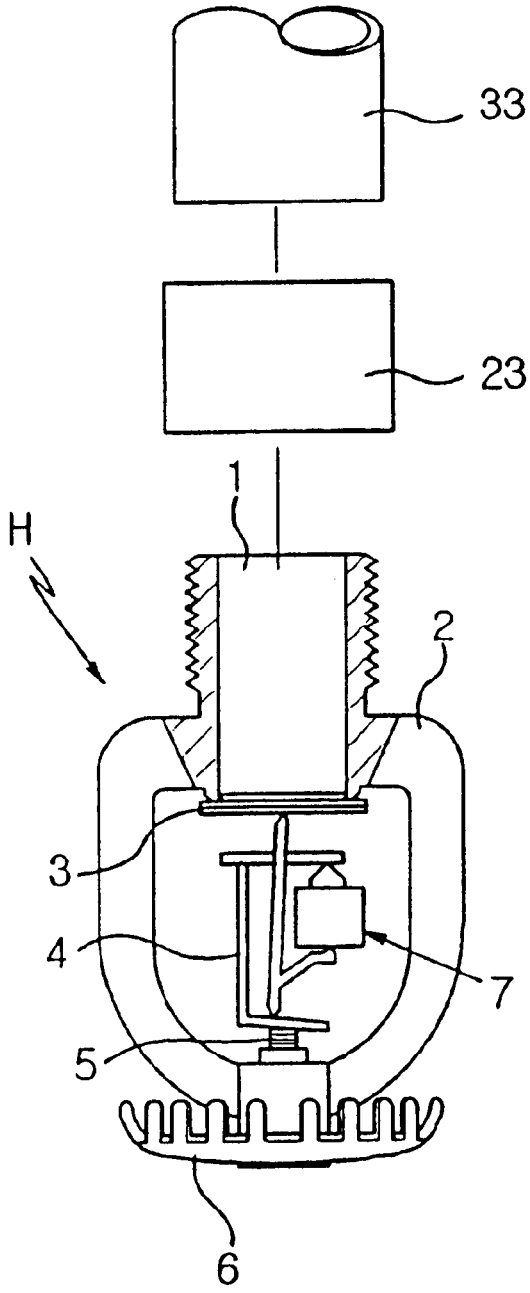
FIG. 9 is a sectional view of a conventional sprinkler head.
Figure 10:
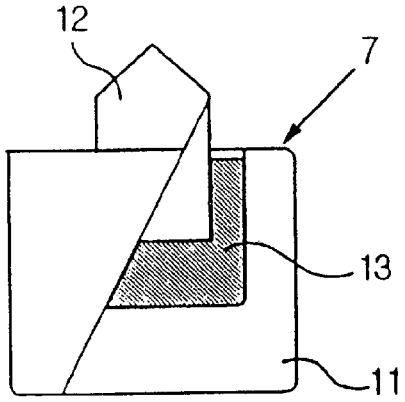
FIG. 10 is an enlarged, sectional view of a low-temperature fusing lead fuse in FIG. 9.
Figure 11:
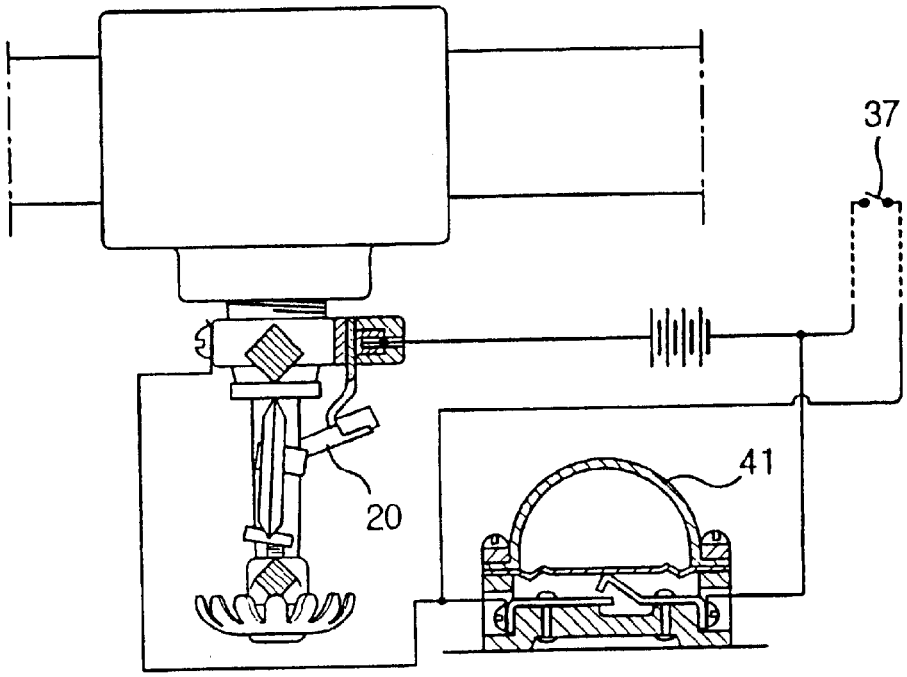
FIG. 11 is a schematic view showing a structure of a conventional sprinkler.
Figure 12A:
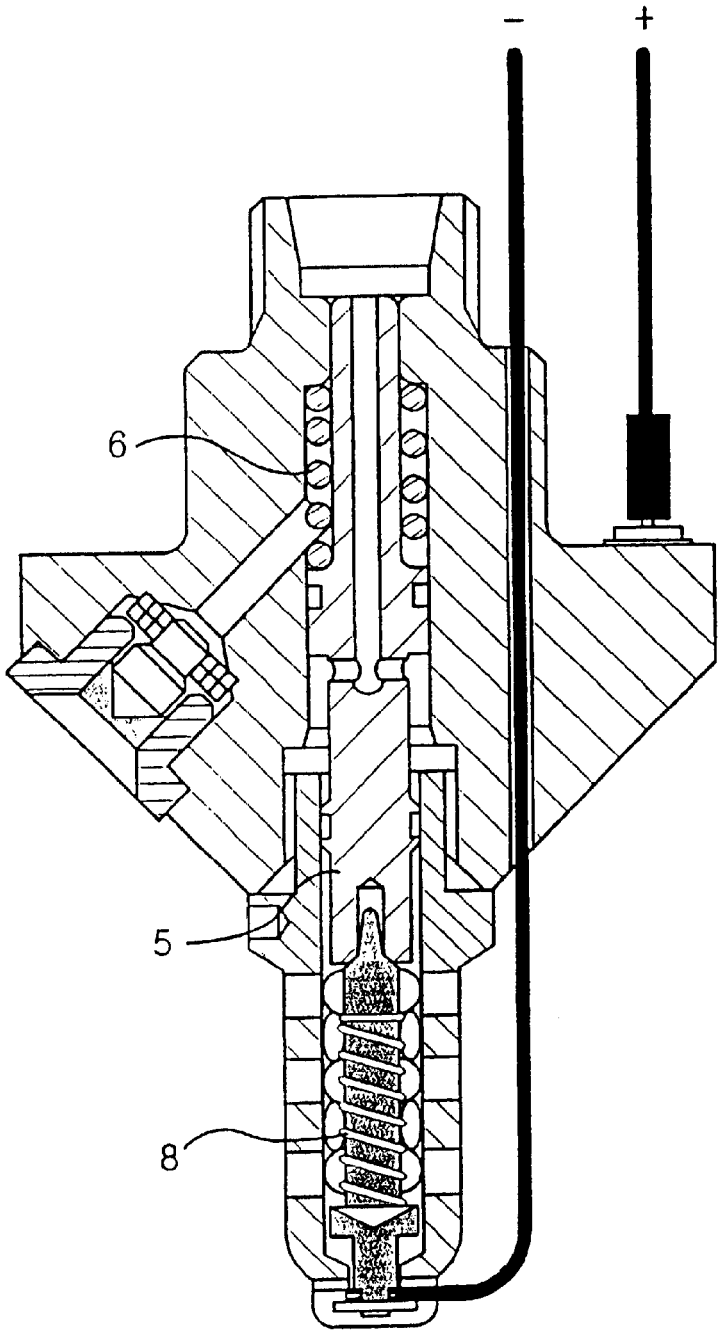
FIG. 12*a* is a sectional view illustrating a state of the sprinkler at room temperature.
Figure 12B:
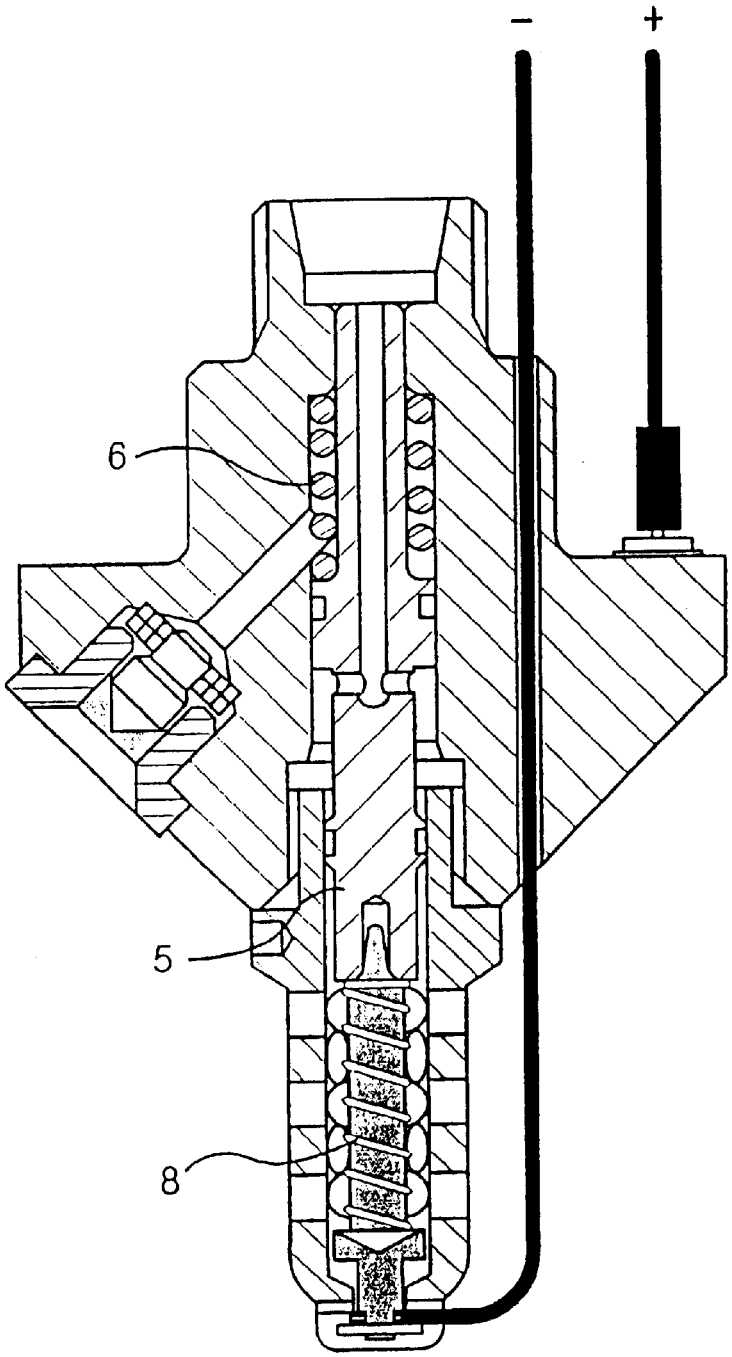
FIG. 12*b* is a sectional view illustrating an expanded state (an ampule heating state) of a memory metal coil.
Figure 12C:
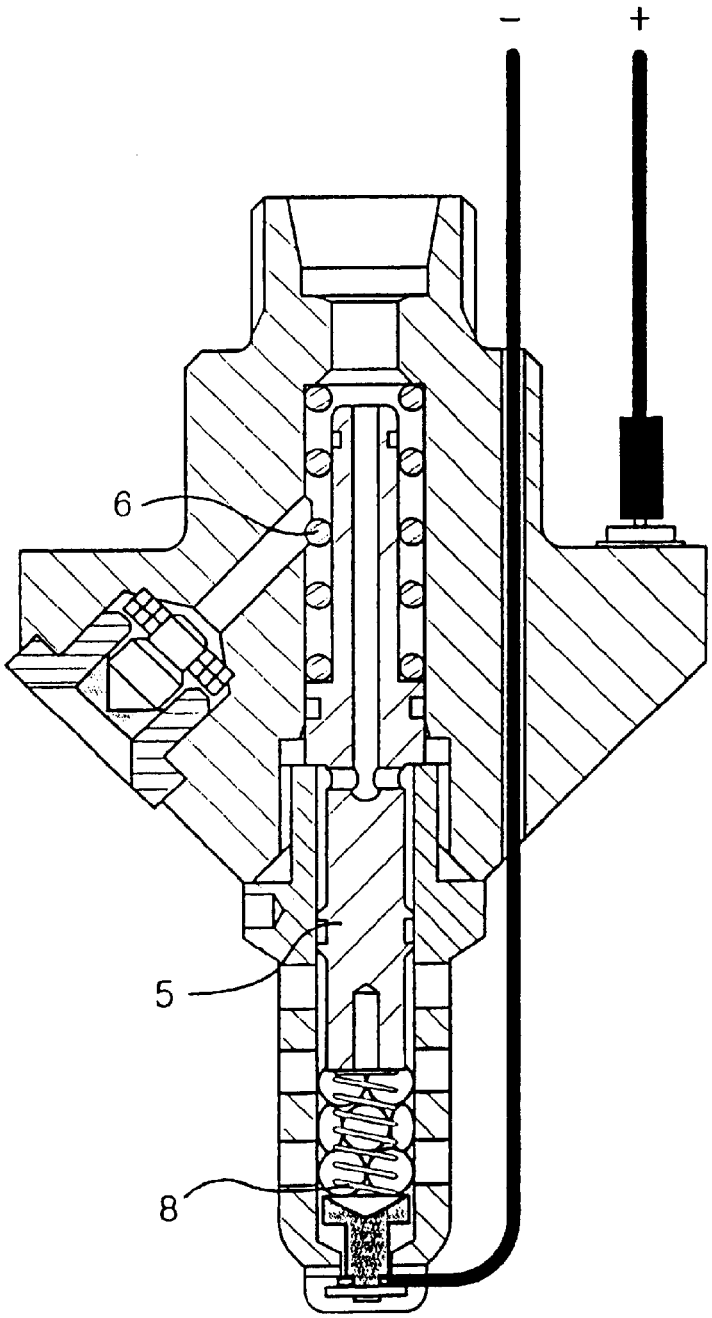
FIG. 12*c* is a sectional view illustrating a pressed state (an extinguishing liquid spraying state) of a spindle after an ampule is broken.

For reference, the sprinkler head controller C and the main computer MC in the central control station transmit and receive signals therebetween on the basis of a communication system which counts the number of synchronous pulses. As shown in FIG. 7, all data start with a synchronous signal in an interval t1 and is then converted into a pulse signal with a corresponding number of pulses. Subsequently, the pulse signal is transmitted while being divided into different intervals t2 and t3. Here, the synchronous signal has a pulse width P1 narrower than that P2 of the data signal (i.e., P1<P2) so that those signals can be identified by the sprinkler head controller C and the main computer MC in the central control station.

First, upon receiving the DC power from the DC power source 92, the sprinkler head controller C is initialized to wait for a command from the main computer MC in the central control station at step S10. Then, the sprinkler head controller C determines at step S20 whether it is called by the main computer MC in the central control station. If the sprinkler head controller C is not called by the main computer MC at step S20, then it performs a self-diagnostic operation for the thermal fuse F at step S30. At step S40, the sprinkler head controller C determines from the self-diagnostic result whether a fault is present in the thermal fuse F. If it is determined at step S40 that the fault is present in the thermal fuse F, then the sprinkler head controller C reports the fault presence to the main computer MC at step S50 and then ends the control operation.

In the case where it is determined at the above step S40 that no fault is present in the thermal fuse F, the sprinkler head controller C senses a current temperature within a place where the related sprinkler is installed, through the temperature sensing circuit TS at step S60 and reports the sensed result to the main computer MC in the central control station at step S55. Then, the sprinkler head controller C determines at step S70 whether the sensed current temperature exceeds a predetermined threshold value (for example, about 70 C.). Upon determining at step S70 that the sensed current temperature exceeds the predetermined threshold value, the sprinkler head controller C recognizes that a fire has occurred and then proceeds to step S120 of actuating the sprinkler. At this step S120, the sprinkler head controller C actuates the sprinkler head H to spray extinguishing liquid.

On the other hand, in the case where it is determined at the above step S70 that the sensed current temperature does not exceed the predetermined threshold value, the sprinkler head controller C stores a value of the sensed current temperature in a memory contained therein at step S80. Thereafter, the sprinkler head controller C reads a previously stored temperature value from the memory at step S90 and calculates a difference between the read previous temperature value and the sensed current temperature value at step S100. Subsequently, the sprinkler head controller C compares the temperature difference calculated at the above step S100 with a predetermined threshold value (for example, about 3 C.) at step S110. If the calculated temperature difference is not greater than the predetermined threshold value as a result of the comparison, then the sprinkler head controller C returns to the above step S20.

In the case where it is determined at the above step S110 that the calculated temperature difference is greater than the predetermined threshold value, the sprinkler head controller C recognizes that a fire has occurred and then actuates the sprinkler head H to spray extinguishing liquid at step S120. Here, the reason for calculating the difference between the current temperature value and the previous temperature value and comparing the calculated temperature difference with the predetermined threshold value is that the sprinkler is allowed to be actuated when the ambient temperature abruptly varies (for example, up to a deviation of 30 C.) as well as when it reaches the predetermined threshold value (for example, 70 C.). That is, when the ambient temperature abruptly varies, the sprinkler head controller C regards such a situation as the occurrence of a fire (i.e., it estimates the fire occurrence at a low temperature) and thus actuates the sprinkler. Thereafter, at step S130, the sprinkler head controller C reports the main computer MC in the central control station that the sprinkler has been actuated and then ends the control operation.

On the other hand, upon being called by the main computer MC in the central control station at the above step S20, the sprinkler head controller C transmits an identification number stored by the switch 51 to the main computer MC to acknowledge the call at step S140. Here, the main computer MC in the central control station identifies the acknowledging sprinkler head controller C in response to the identification number therefrom and transmits a command to the acknowledging controller C. Upon receiving the command from the main computer MC in the central control station, the sprinkler head controller C analyzes the received command at step S150 to determine at step S160 whether the main computer MC has instructed to perform the self-diagnostic operation for the thermal fuse F. If it is determined at step SI 60 that the main computer MC has instructed to perform the self-diagnostic operation for the thermal fuse F, then the sprinkler head controller C proceeds to the above step S30 of performing the self-diagnostic operation. However, if it is determined at step S160 that the main computer MC has not instructed to perform the self-diagnostic operation for the thermal fuse F, then the sprinkler head controller C determines at step S170 whether the main computer MC has instructed to actuate the sprinkler. Upon determining at step S170 that the main computer MC has not instructed to actuate the sprinkler, the sprinkler head controller C returns to the above step S20. However, in the case where it is determined at step S170 that the main computer MC has instructed to actuate the sprinkler, the sprinkler head controller C proceeds to the above step S120 to actuate the sprinkler.

In the present sprinkler apparatus constructed and operated as mentioned above, a plurality of sprinkler head controllers are connected in parallel to the main computer MC in the central control station via communication lines so that they can be controlled in a centralized manner by the main computer MC. This construction allows the operator in the central control station to readily discover a sprinkler with a fault through the main computer MC. Further, upon receiving a report from a certain one of the sprinkler head controllers on the occurrence of a fire, the operator controls others installed in places adjacent to the reporting sprinkler head controller to actuate sprinklers in those places. Therefore, the present sprinkler apparatus can prevent the fire from being spread and thus effectively fight the fire.

Industrial Applicability

As apparent from the above description, according to the present invention, sprinkler head controllers provided in sprinklers installed in respective places sense temperatures through temperature sensing circuits and actuate the associated sprinklers in accordance with the sensed results, respectively. Therefore, the present sprinkler apparatus can not only minimize faulty operations of the sprinklers, but also estimate the occurrence of a fire at the initial stage prior to the spreading of the fire and spray extinguishing liquid.

Further, according to the present invention, sprinkler head controllers provided in sprinklers installed in respective places check the presence of faults in the associated sprinklers by themselves and report the checked results to a main computer in a central control station, respectively. Therefore, an operator in the central control station can readily discover a sprinkler with a fault through the main computer.

Further, according to the present invention, a main computer in a central control station receives reports from sprinkler head controllers on actuated states of associated sprinklers installed in respective places and instructs the sprinkler head controllers to actuate the associated sprinklers on the basis of the received reports. Accordingly, upon receiving a report from a certain one of the sprinkler head controllers on the occurrence of a fire, an operator in a central control station can control others installed in places adjacent to the reporting sprinkler head controller to actuate sprinklers in those places. Therefore, the present sprinkler apparatus can prevent the fire from being spread and thus effectively fight the fire in complex buildings such as edifices.

Further, according to the present invention, a plurality of sprinkler head controllers are connected in parallel to a main computer in a central control station via signal lines of a two-phase/four-wire system. Therefore, the wire layout can be simplified and the signal lines can significantly be reduced in number regardless of the number of sprinklers installed in a building.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A sprinkler apparatus comprising a heater operable by temperature sensing means, a thermal fuse melting by heat from the heater, and a valve plate for opening an extinguishing liquid discharging nozzle of a sprinkler head in response to the melting of the thermal fuse to discharge extinguishing liquid, wherein the sprinkler apparatus further comprises:

a sprinkler head controller including a transmitter and a receiver, the sprinkler head controller performing a self-diagnostic operation according to an algorithm contained therein in such a manner that it supplies a small amount of current to the heater and detects the amount of current flowing through the heater and externally transmitting the self-diagnostic result and a temperature value sensed by the temperature sensing means; and a main computer installed in a central control station for informing an operator of the self-diagnostic result and temperature value transmitted from the sprinkler head controller.

2. The sprinkler apparatus as set forth in claim 1, wherein the sprinkler head controller includes:

an one-chip microcontroller for generating a current generation signal in response to the temperature value sensed by the temperature sensing means or a control signal from the main computer in the central control station;

current supply means for supplying a predetermined amount of current to the heater in response to the current generation signal from the microcontroller; and current feedback means for detecting the amount of current flowing through the heater and outputting a signal based on the detected current amount to the microcontroller.

3. The sprinkler apparatus as set forth in claim 2, wherein the current generation signal from the microcontroller is a pulse width modulation signal; and wherein the current supply means includes:

a control photocoupler enabled in response to the pulse width modulation signal received from the microcontroller; and a switching transistor enabled in response to the enabling of the control photocoupler.

4. The sprinkler apparatus as set forth in claim 2, wherein the current feedback means includes:

a resistor connected in series between a current supply line and the heater;

a current sensing photocoupler having a light emitting diode connected in parallel to the resistor and a phototransistor connected to an input terminal of the microcontroller; and a current sensing capacitor having its one end connected to an output terminal of the phototransistor and its other end connected to a ground voltage terminal; and wherein the microcontroller is adapted to detect charging/discharging times of the current sensing capacitor and determine the amount of current flowing through the heater on the basis of the detected charging/discharging times.

5. The sprinkler apparatus as set forth in claim 1, wherein the main computer in the central control station is adapted to transmit a control command to the sprinkler head controller according to a key operation by the operator or an algorithm contained therein to instruct the sprinkler head controller to perform the self-diagnostic operation; and wherein the sprinkler head controller is adapted to perform the self-diagnostic operation by itself or in response to the control command from the main computer and transmit the self-diagnostic result to the main computer.

6. The sprinkler apparatus as set forth in claim 5, wherein the sprinkler head controller includes:

a one-chip microcontroller for generating a current generation signal in response to the temperature value sensed by the temperature sensing means or a control signal received from the main computer in the central control station;

current supply means for supplying a predetermined amount of current to the heater in response to the current generation signal received from the microcontroller; and current feedback means for detecting the amount of current flowing through the heater and outputting a signal based on the detected current amount to the microcontroller.

7. The sprinkler apparatus as set forth in claim 6, wherein the current generation signal from the microcontroller is a pulse width modulation signal; and wherein the current supply means includes:

a control photocoupler enabled in response to the pulse width modulation signal from the microcontroller; and a switching transistor enabled in response to the enabling of the control photocoupler.

8. The sprinkler apparatus as set forth in claim 6, wherein the current feedback means includes:

a resistor connected in series between a current supply line and the heater;

a current sensing photocoupler having a light emitting diode connected in parallel to the resistor and a phototransistor connected to an input terminal of the microcontroller; and a current sensing capacitor having its one end connected to an output terminal of the phototransistor and its other end connected to a ground voltage terminal; and wherein the microcontroller is adapted to detect charging/discharging times of the current sensing capacitor and determine the amount of current flowing through the heater on the basis of the detected charging/discharging times.

9. The sprinkler apparatus as set forth in claim 1, wherein the main computer in the central control station is adapted to transmit a control command to the sprinkler head controller according to a key operation by the operator or an algorithm contained therein to command the sprinkler head controller to, on command, actuate the sprinkler head; and wherein the sprinkler head controller is adapted to actuate the sprinkler head by itself in response to the temperature value sensed by the temperature sensing means or compulsorily irrespective of the temperature value in response to the control command from the main computer.

10. The sprinkler apparatus as set forth in claim 9, wherein the sprinkler head controller includes:

a one-chip microcontroller for generating a current generation signal in response to either the temperature value sensed by the temperature sensing means or a control signal received from the main computer in the central control station;

current supply means for supplying a predetermined amount of current to the heater in response to the current generation signal from the microcontroller; and current feedback means for detecting the amount of current flowing through the heater and outputting a signal based on the detected current amount to the microcontroller.

11. The sprinkler apparatus as set forth in claim 10, wherein the current generation signal from the microcontroller is a pulse width modulation signal; and wherein the current supply means includes:

a control photocoupler enabled in response to the pulse width modulation signal from the microcontroller; and a switching transistor enabled in response to the enabling of the control photocoupler.

12. The sprinkler apparatus as set forth in claim 10, wherein the current feedback means includes:

a resistor connected in series between a current supply line and the heater;

a current sensing photocoupler having a light emitting diode connected in parallel to the resistor and a phototransistor connected to an input terminal of the microcontroller; and a current sensing capacitor having its one end connected to an output terminal of the phototransistor and its other end connected to a ground voltage terminal; and wherein the microcontroller is adapted to detect charging/discharging times of the current sensing capacitor and determine the amount of current flowing through the heater on the basis of the detected charging/discharging times.

13. The sprinkler apparatus as set forth in claim 1, wherein a plurality of sprinkler head controllers are connected to the main computer in the central control station to be operable according to algorithms contained therein and in response to control commands from the main computer, respectively.

14. The sprinkler apparatus as set forth in claim 13, wherein the plurality of sprinkler head controllers are connected in parallel to the main computer via signal transmission/reception lines of a two-phase/four-wire system.

15. The sprinkler apparatus as set forth in claim 14, wherein a plurality of bypassing diodes are connected to each of the signal transmission/reception lines to prevent signal interferences with the other sprinkler head controllers connected in parallel to the same line.

16. A method of controlling a sprinkler apparatus which includes at least one sprinkler head having a heater for generating heat and a thermal fuse melting by the heat from the heater to actuate the sprinkler head, at least one sprinkler head controller for controlling the operation of the sprinkler head, and a main computer installed in a central control station, the method comprising:

allowing the sprinkler head controller to actuate the sprinkler head in accordance with a temperature value sensed by temperature sensing means and transmit information about the sensed temperature value and the actuated state of the sprinkler head to the main computer;

allowing the sprinkler head controller to perform a self-diagnostic operation for the sprinkler head according to an algorithm contained therein or in response to a control command from the main computer and transmit the self-diagnostic result to the main computer; and allowing the main computer in the central control station to inform an operator of the sensed temperature value, the actuated state of the sprinkler head and the self-diagnostic result transmitted from the sprinkler head controller.

17. The method as set forth in claim 16, wherein the allowing the sprinkler head controller to actuate the sprinkler head comprises actuating the sprinkler head by itself in response to either the temperature value sensed by the temperature sensing means or on command irrespective of the temperature value in response to the control command from the main computer.

18. The method as set forth in claim 17, wherein the allowing the sprinkler head controller to actuate the sprinkler head comprises:

actuating the sprinkler head if the temperature value sensed by the temperature sensing means exceeds a first predetermined threshold value and storing the sensed temperature value in a memory if it does not exceed the first predetermined threshold value;

comparing the sensed temperature value with a temperature value previously stored in the memory to calculate a difference therebetween; and actuating the sprinkler head if the calculated temperature difference exceeds a second predetermined threshold value.

19. The method as set forth in claim 16, wherein the allowing the sprinkler head controller to perform a self-diagnostic operation comprises performing the self-diagnostic operation by supplying a sufficiently small amount of current as not to melt the thermal fuse, to the heater and thermal fuse for a predetermined period of time, feedback-detecting the amount of current flowing through the heater and checking the presence of a fault in the sprinkler head and an aged state thereof on the basis of the detected current amount.

20. The method as set forth in claim 19, wherein the allowing the sprinkler head controller to actuate the sprinkler head comprises actuating the sprinkler head by itself in response to the temperature value sensed by the temperature sensing means or on command irrespective of the temperature value in response to the control command from the main computer.

21. The method as set forth in claim 20, wherein the allowing the sprinkler head controller to actuate the sprinkler head comprises:

actuating the sprinkler head if the temperature value sensed by the temperature sensing means exceeds a first predetermined threshold value and storing the sensed temperature value in a memory if it does not exceed the first predetermined threshold value;

comparing the sensed temperature value with a temperature value previously stored in the memory to calculate a difference therebetween; and actuating the sprinkler head if the calculated temperature difference exceeds a second predetermined threshold value.

22. A sprinkler apparatus, comprising:

a sprinkler head having a heater and a thermal fuse, the heater configured to generate first and second amounts of heat based on first and second currents, the thermal fuse melting under exposure to the second heat, the sprinkler head configured to discharge an extinguishing liquid therethrough in response to the melting of the thermal fuse; and a sprinkler head controller connected to the sprinkler head, and configured to provide the first current to the heater and detect the amount of current flowing through the heater, and determine the operational status of the sprinkler head based on the detected current.

23. The sprinkler apparatus of claim 22, wherein the sprinkler head controller is configured to check whether the sprinkler head is broken, aged, or damaged.

24. The sprinkler apparatus of claim 22, wherein the sprinkler head controller is configured to periodically diagnose the status of the sprinkler head.

25. The sprinkler apparatus of claim 22, wherein the first current is less than the second current.

26. The sprinkler apparatus of claim 25, wherein the first current is a predetermined current that does not substantially melt the thermal fuse.

27. The sprinkler apparatus of claim 22, further comprising a temperature sensor configured to detect an ambient temperature value and provide the detected temperature value to the sprinkler head controller.

28. The sprinkler apparatus of claim 27, wherein the sprinkler head controller is configured to provide the second current to the heater if the received temperature value from the sensor is greater than a predetermined value.

29. The sprinkler apparatus of claim 22, further comprising a main computer configured to transmit a first control command to the sprinkler head controller, and wherein the sprinkler head controller is configured to transmit the diagnosed result to the main computer in response to the first control command.

30. The sprinkler apparatus of claim 22, further comprising a main computer configured to transmit a second control command to the sprinkler head controller, and wherein the sprinkler head controller is configured to provide the second current to the sprinkler head based on the second control command.

31. The sprinkler apparatus of claim 22, wherein the sprinkler head controller includes:

a one-chip microcontroller configured to generate a current generation signal;

a current supply portion configured to supply the first or second current to the heater in response to the current generation signal; and a current feedback portion configured to detect the amount of current flowing through the heater and provide the detection signal to the microcontroller.

32. The sprinkler apparatus of claim 31, wherein the current generation signal is a pulse width modulation signal.

33. The sprinkler apparatus of claim 32, wherein the current supply portion includes:

a control photocoupler being enabled in response to the pulse width modulation signal from the microcontroller; and a switching transistor being enabled in response to the enabling of the control photocoupler.

34. The sprinkler apparatus of claim 31, wherein the current feedback portion includes:

a resistor connected in series between a current supply line and the heater;

a current sensing photocoupler having a light emitting diode connected in parallel to the resistor and a phototransistor connected to an input terminal of the microcontroller; and a current sensing capacitor having its one end connected to an output terminal of the phototransistor and its other end connected to a ground voltage terminal; and wherein the microcontroller is configured to detect charging/discharging times of the current sensing capacitor and determine the amount of current flowing through the heater on the basis of the detected charging/discharging times.

35. A method of controlling a sprinkler apparatus that includes a sprinkler head, the sprinkler head configured to receive first and second currents, and to discharge an extinguishing liquid based on the second current, the method comprising:

providing the first current to the sprinkler head;

allowing the first current to flow through the sprinkler head;

detecting the amount of current flowing through the sprinkler head;

determining the operational status of the sprinkler head based on the detected current;

detecting an ambient temperature value around the sprinkler head; and providing the detected temperature value to a main computer.

36. A method of controlling a sprinkler apparatus that includes a sprinkler head, the sprinkler head configured to receive first and second currents, and to discharge an extinguishing liquid based on the second current, the method comprising:

providing the first current to the sprinkler head;

allowing the first current to flow through the sprinkler head;

detecting the amount of current flowing through the sprinkler head;

determining the operational status of the sprinkler head based on the detected current;

detecting an ambient temperature value around the sprinkler head; determining if the detected temperature value is greater than a predetermined value; and providing the second current to the sprinkler head if the detected temperature value is greater than the predetermined value.

37. The method of claim 36, wherein the detecting comprises:

charging a capacitor with the current flowing through the sprinkler head; and detecting charging and discharging times of the capacitor.

38. A method of controlling a sprinkler apparatus that includes a sprinkler head, the sprinkler head configured to receive first and second currents, and to discharge an extinguishing liquid based on the second current, the method comprising:

providing the first current to the sprinkler head;

allowing the first current to flow through the sprinkler head;

detecting the amount of current flowing through the sprinkler head;

determining the operational status of the sprinkler head based on the detected current;

detecting a first ambient temperature value around the sprinkler head; storing the first ambient temperature value;

detecting a second ambient temperature value around the sprinkler head after a predetermined time period;

obtaining the difference between the stored first ambient temperature value and the second ambient temperature value; and providing the second current to the sprinkler head if the difference is greater than the predetermined value.

39. A sprinkler apparatus, comprising:

a plurality of sprinkler devices, each sprinkler device including a sprinkler head and a sprinkler head controller; and a main computer configured to control the plurality of sprinkler devices;

wherein the sprinkler head includes a heater and a thermal fuse, the heater configured to generate first and second amounts of heat based on first and second currents, the thermal fuse melting under exposure to the second heat, and wherein the sprinkler head is configured to discharge an extinguishing liquid in response to the melting of the thermal fuse; and wherein the sprinkler head controller is connected to the sprinkler head, and is configured to provide the first current with the heater and detect the amount of current flowing through the heater, and determine the operational status of the sprinkler head based on the detected current.

40. The sprinkler apparatus of claim 39, wherein the plurality of sprinkler head controllers are connected in parallel to the main computer via signal transmission/reception lines of a two-phase/four-wire system.

41. The sprinkler apparatus of claim 39, wherein a plurality of bypassing diodes are connected to each of the signal transmission/reception lines to prevent signal interferences with the other sprinkler head controllers connected in parallel to the same line.

42. The sprinkler apparatus of claim 39, wherein at least one of the plurality of sprinkler devices is configured to detect an ambient temperature value around each corresponding sprinkler head, and to provide the temperature value to the main computer if it is determined that the temperature value is greater than a predetermined value.

43. The sprinkler apparatus of claim 42, herein the main computer is configured to provide a command to at least one sprinkler device adjacent to the one of the plurality of sprinkler devices which is responsive to the received temperature value, the command allowing each of the adjacent sprinkler devices to provide the second current to each corresponding sprinkler head.

44. The sprinkler apparatus of claim 38, wherein the first current is less than the second current.

45. The sprinkler apparatus of claim 44, wherein the first current is a predetermined current that does not substantially melt the thermal fuse.

* * * * *